United States Patent [19]

Blackburn et al.

[11] Patent Number: 4,716,020

[45] Date of Patent: Dec. 29, 1987

[54] TITANIUM ALUMINUM ALLOYS CONTAINING NIOBIUM, VANADIUM AND MOLYBDENUM

[75] Inventors: Martin J. Blackburn, Kensington; Michael P. Smith, Glastonbury, both of Conn.

[73] Assignee: United Technologies Corporation, Hartford, Conn.

[21] Appl. No.: 424,668

[22] Filed: Sep. 27, 1982

[51] Int. Cl.[4] ..... C22C 14/00

[52] U.S. Cl. ..... 420/418; 420/420; 148/12.7 B; 148/407; 148/133

[58] Field of Search ..... 420/418, 420; 148/11.5 F, 12.7 B, 133, 407

[56] References Cited

U.S. PATENT DOCUMENTS

| | | | |
|---|---|---|---|
| 2,754,203 | 7/1956 | Vordahl | 420/420 |
| 2,880,087 | 3/1959 | Jaffee | 148/133 |
| 2,968,586 | 1/1961 | Vordahl | 148/133 |
| 4,292,077 | 9/1981 | Blackburn et al. | 75/175.5 |
| 4,294,615 | 10/1981 | Blackburn et al. | 420/420 |

FOREIGN PATENT DOCUMENTS

| | | |
|---|---|---|
| 782564 | 9/1957 | United Kingdom . |
| 2060694 | 5/1981 | United Kingdom . |

*Primary Examiner*—John F. Terapane
*Assistant Examiner*—Eric Jorgensen
*Attorney, Agent, or Firm*—C. G. Nessler; James M. Rashid

[57] ABSTRACT

The high temperature strength to density ratio of titanium aluminum niobium alloys of the $Ti_3Al$ (alpha two) type is increased when molybdenum is added. New alloys contain by atomic percent 25–27 aluminum, 11–16 (niobium+molybdenum), 1–4 molybdenum, balance titanium. When vanadium replaces up to 3.5% molybdenum a lighter weight alloy is produced. The new alloys have higher elastic modulus and higher creep strength to density ratio than alloys without molybdenum.

11 Claims, 2 Drawing Figures

TITANIUM ALUMINUM ALLOYS CONTAINING NIOBIUM, VANADIUM AND MOLYBDENUM

The U.S. government has rights in the invention pursuant to Contract F33615-80-C-5163 awarded by the Air Force.

TECHNICAL FIELD

This invention relates to titanium base alloys of the $Ti_3Al$ (alpha-two) type which have both good elevated temperature properties and sufficient low temperature ductility to make them useful in an engineering sense.

BACKGROUND ART

The present invention is an improvement on the alloys described in U.S. Pat. No. 4,292,077, issued to the applicants herein and having common assignee herewith. As indicated in the patent, the new alloys are comprised of aluminum, niobium and titanium. The compositional ranges for the patented alloys were quite narrow since changes in properties were discovered to be very sensitive to the precise composition. Generally, the patented alloys contain titanium, 24–27 atomic percent aluminum and 11–16 atomic percent niobium. The alloys have at least 1.5% tensile elongation at room temperature and good elevated temperature creep strength, thus permitting their potential substitution for certain nickel base alloys such as INCO 713C.

In an important embodiment of the prior invention, vanadium partially replaces niobium in atomic amounts of 1–4%. This substitution desirably lowers the density of the alloy but at the same time the favorable high temperature properties are retained. An optimum atomic composition range for this embodiment is 24–26% aluminum, 10–12% niobium and 2–4% vanadium.

While the foregoing patented alloys meet the requirement of having creep rupture life at 650° C./380 MPa which is equal to INCO 713C on a density adjusted basis, the alloys have less tensile strength at temperatures up to 400° C. than does the commercial beta processed alloy Ti-6-2-4-2 (by weight percent Ti-6Al-2Sn-4Zr-2Mo). Consequently, compositional modifications of the patented alloys were evaluated to see if improvements could be achieved. As the general field of titanium alloys indicates, there are many potential alloying ingredients. But, as the prior work demonstrated, the composition of useful $Ti_3Al$ alloys is extremely critical. Many elemental additions which have been common in other titanium alloys were previously shown to be of no advantage in $Ti_3Al$ alloy.

Disclosure of the Invention

An object of the invention is to provide $Ti_3Al$ type alloys which have a superior combination of creep rupture life and tensile strength at elevated temperatures in the 600° C. range, but which alloys at the same time have sufficient ductility to enable their use at room temperature and their fabrication by conventional processes associated with titanium base alloys.

According to the invention, new titanium base alloys contain by atomic percent 25–27 aluminum, 11–16 (niobium+molybdenum) and 0.5–4 molybdenum. Preferably they have 0.5–1.5 Mo. An especially preferred embodiment of the invention is the lighter weight alloy containing vanadium in substitution for a portion of the niobium. Such an alloy contains by atomic percent 25–27 Al, 11–16 (Nb+V+Mo), 1–4 (V+Mo), at least 0.5 Mo, balance titanium. More preferably, the light weight alloy contains 9–11 Nb, 1–3 V and 0.5–3 Mo, balance titanium.

The incorporation of molybdenum substantially increases high temperature ultimate tensile strength and creep rupture properties, compared to the essential alloys of our prior invention which did not contain molybdenum.

The foregoing and other objects, features and advantages of the present invention will become more apparent from the following description of preferred embodiments and accompanying drawings.

BEST MODE FOR CARRYING OUT THE INVENTION

Figure 1:
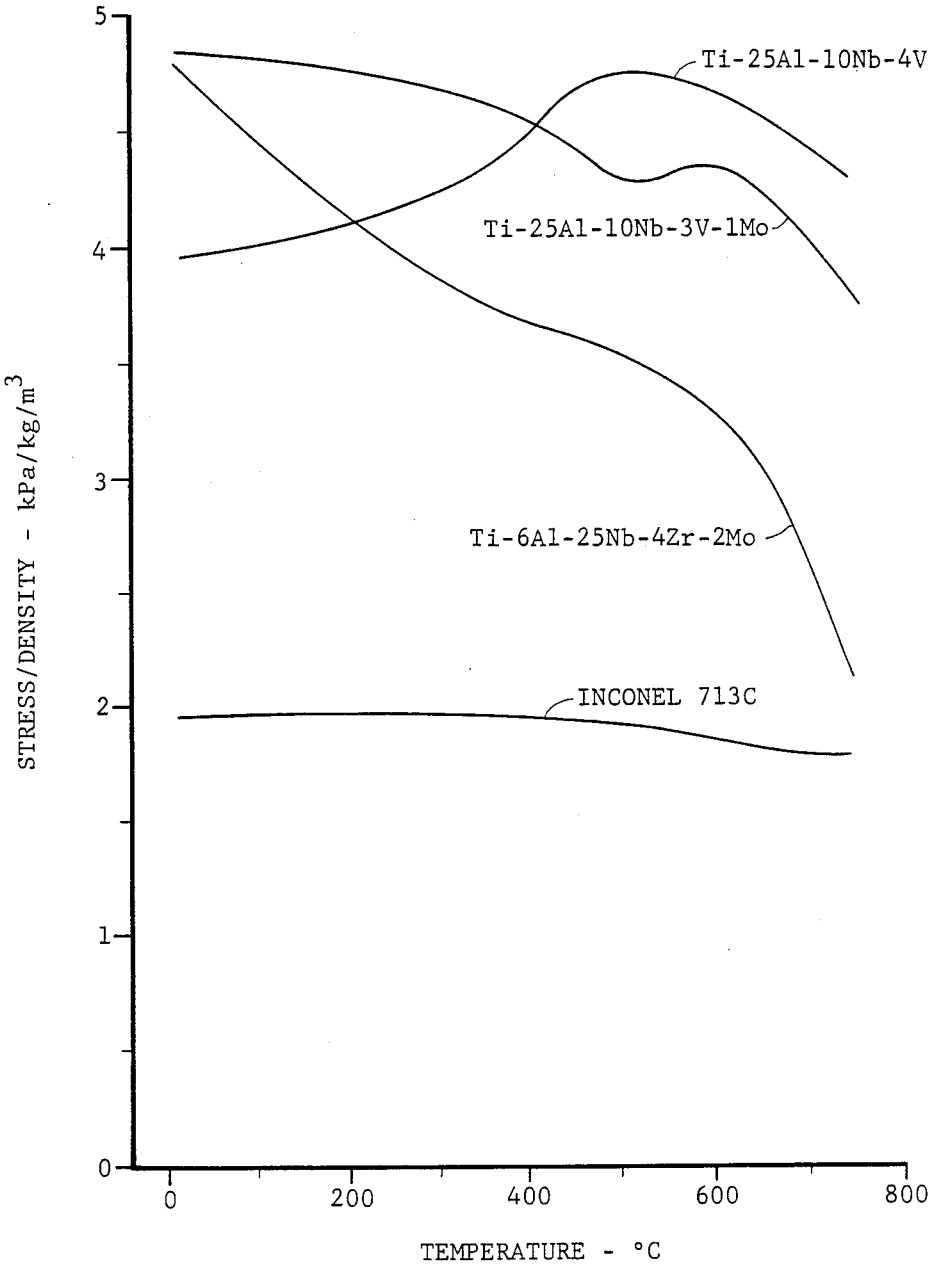
FIG. 1 is a graph showing the comparative ultimate tensile strength-to-density ratio for various known alloys, compared to the invention.

The best mode of the invention is described in terms of atomic percent of elements. Those skilled in the metallurgical arts will recognize the limitations on stating the invention by weight percent and the utility of stating the invention by the preferred atomic percent; they will be able to readily convert from atomic percents to exact weight percents for particular embodiment alloys.

The alloys of the present invention are based essentially on the compositions which we disclose in our U.S. Pat. No. 4,292,077, the disclosure of which is incorporated by reference. Those alloys contain a critical combination of Ti, Nb and Al. In the patent we showed that the essential invention could be enhanced by including substituting 4% V for Nb, thereby lowering density. In making and disclosing the present invention, we have used the light weight vanadium containing version of our prior invention. Our work described herein shows that Mo is a particularly unique and valuable addition to the essential Ti-Nb-Al alloys of our prior patent.

The alloys described herein were manufactured using conventional titanium base alloy technology, basically vacuum arc melting and isothermal forging which is quite familiar (albeit isothermal forging is a recent improvement). Alloys of the $Ti_3Al$ composition have been developed to the extent that large ingots, weighing up to 245 kg may be procured on a routine basis from commercial sources. In the invention, the alloys are cast, forged and heat treated. The procedures for manufacture and testing of forgings are the same as those described in U.S. Pat. No. 4,292,077.

An exemplary alloy demonstrating the invention is Ti-25Al-10Nb-3V-1Mo. (All compositions hereinafter are in atomic percent unless otherwise stated.) The alloy has a density of about 3% greater than that of Ti-25Al-10Nb-4V, which is 4.5 g/cc. The alloy was isothermally beta forged (the cylindrical cast ingot pressed to a disk shape approximately 14% of the original ingot height) at a temperature of about 1120° C. This is about 40° C. over the beta transus, estimated to be about 1080° C. Tables 1 and 2 show respectively the tensile and creep rupture properties of the alloy.

TABLE 1

Tensile Properties of Isothermally Beta Forged and Heat Treated Ti—25Al—10Nb—3V—1Mo Alloy

| Specimen | Temperature °C. | 0.2% Yield Strength MPa | Ultimate Tensile Strength-MPa | El% | RA% |
|---|---|---|---|---|---|
| A | 25 | 825 | 1047 | 2.2 | 1.7 |
| B | 260 | 831 | 1058 | 9.2 | 14.1 |
| C | 427 | 729 | 950 | 12.1 | 16.9 |
| D | 538 | 647 | 967 | 9.2 | 13.0 |
| E | 650 | 640 | 835 | 9.1 | 14.3 |

TABLE 2

Creep-Rupture Properties of Isothermally Beta Forged and Heat Treated Ti—25Al—10Nb—3V—1Mo Alloy

| Specimen | Test Conditions °C./MPa | Time in Hours To 0.2% El | 0.5% El | 1.0% El | Rupture |
|---|---|---|---|---|---|
| F | 650/380 | 2.8 | 31.1 | 184.5 | * |
| G | 650/380 | 1.4 | 12.0 | 66.3 | 222.8 |
| H | 593/413 | 27.0 | 405.6 | * | * |

*Test terminated at 502 Hours without rupture

FIG. 1 shows how the ultimate tensile strength to density ratio of our new alloy compares with those of a similar alloy lacking molybdenum and two commercial alloys, alloy Ti-6-2-4-2 and nickel base alloy INCO 713C. It is seen that the new alloy provides a significant improvement.

Figure 2:
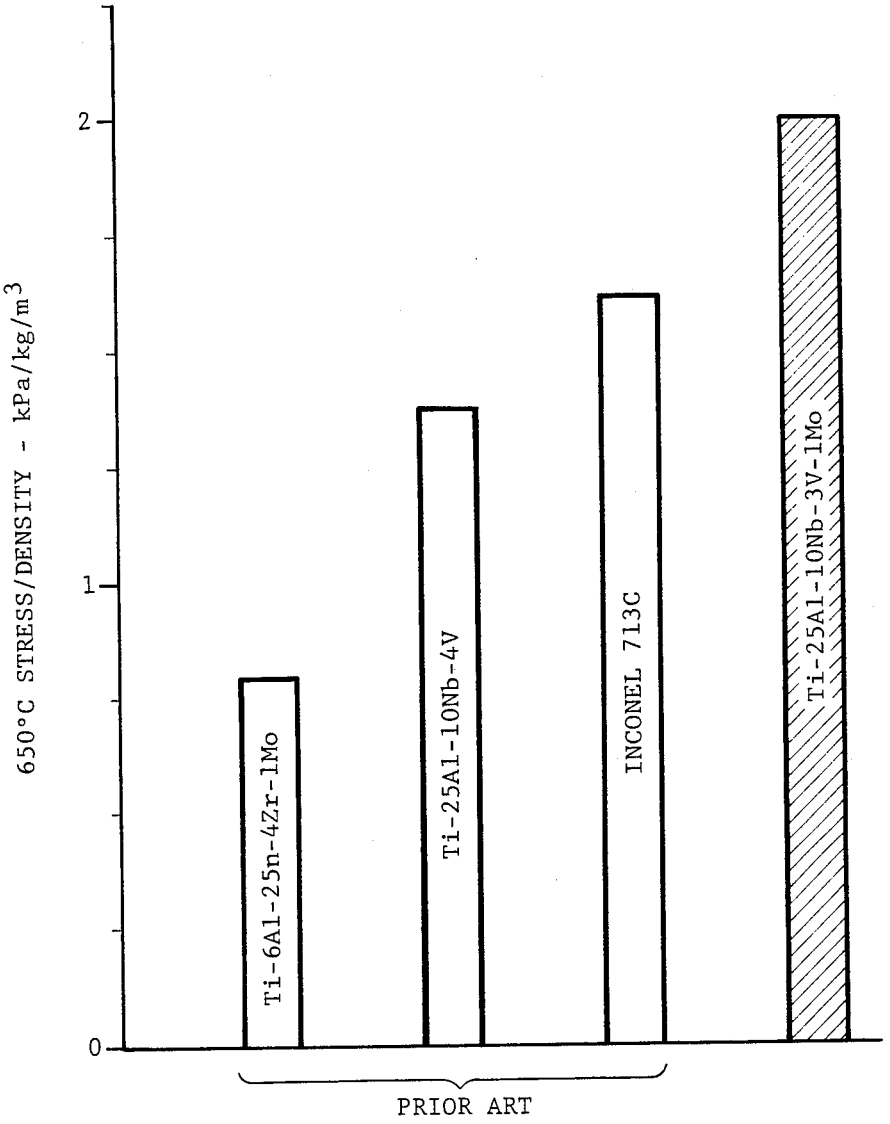
FIG. 2 is a bar chart showing comparative stress rupture properties on a density adjusted basis for the invention compared to various known alloys.

FIG. 2 shows how the density-adjusted stress for 300 hr rupture life at 650° C. for the alloy containing molybdenum is substantially improved over the creep rupture life for a similar alloy lacking molybdenum.

Generally, our alloys will be characterized in their optimally forged and heat treated condition by a tensile ductility at room temperature of at least 1.5%, typically about 2.5%; an ultimate tensile strength of 1000 MPa at 25° C.; and a 650° C./372 MPa creep life of at least 150 hours, typically about 300 hours. They have stress-to-density ratios of the order of 2 kPa/m$^3$, compared to less than 1.5 kPa/m$^3$ for the alloys of our prior patent, and compared to even lower values for older alloys.

Our new alloys also have desirably increased dynamic elastic modulus compared to other alloys, as indicated in Table 3. The Ti-25Al-10Nb-3V-1Mo 650° C. modulus is almost 30% greater than the value for Ti-25Al-10Nb-4V, and a significant improvement over commercial alloys as well. The modulus was measured by mechanically stimulating resonant vibration of a beam of known dimensions and measuring the frequency response thereof. Calculation is made from known dynamics relationships.

TABLE 3

Dynamic Modulus of Selected Alloys ($10^7$kPa)

| | Temperature - °C. 20 | 315 | 650 |
|---|---|---|---|
| Ti—6Al—2Sn—4Zr—2Mo | 11.9 | 10.4 | 8.6 |
| Ti—25Al—10Nb—4V | 10.1 | 9.7 | 8.7 |
| Ti—25Al—10Nb—3V—1Mo | 12.6 | 12.1 | 11.2 |

As much as 6–8% Mo may be included in our new alloys, since as Mo content rises, creep strength and stiffness rise. However, density and oxidation resistance (necessary for high temperature gas turbine use) decrease. Thus, for such alloys the Mo should be limited to about 4% and preferably it is 0.5–1.5%. Our basic Ti-Nb-Al-Mo alloys are useful, but they are ever more useful when V is used in place of Nb in accord with our prior invention. But since V like Mo decreases oxidation resistance, the total content of (V+Mo) should be maintained at less than 4%. Thus, our new alloys will essentially consist of Ti, Al, Nb, Mo. They preferably will contain V. Tungsten may substitute in part or whole for Mo, as indicated below. Other intentional additions may be included in our essential alloys, such as less than 1% C or Si in replacement of Ti.

Table 4 shows the lightest and heaviest embodiments of our invention in weight percent. We provide this as a reference for the future.

TABLE 4

Weight Percentages (w/o) for the Invention in Atomic Percentages (a/o)

| Alloy | | Element Al | Mo | Nb | V | Ti |
|---|---|---|---|---|---|---|
| A | a/o | 25 | 4 | 12 | — | 59 |
| | w/o | 13.5 | 7.7 | 27.3 | — | 56.5 |
| B | a/o | 27 | 0.5 | 10.5 | — | 62 |
| | w/o | 15.4 | 1.0 | 20.6 | — | 63 |
| C | a/o | 25 | 1.5 | 14.5 | — | 59 |
| | w/o | 13.5 | 2.9 | 26.9 | — | 56.7 |
| D | a/o | 27 | 0.5 | 10.5 | — | 62 |
| | w/o | 15.4 | 1.0 | 20.6 | — | 63.0 |
| E | a/o | 25 | 3.5 | 12.0 | 0.5 | 59 |
| | w/o | 13.6 | 6.7 | 22.4 | 0.5 | 56.8 |
| F | a/o | 27.0 | 0.5 | 7.0 | 3.5 | 62 |
| | w/o | 16.0 | 1.0 | 14.2 | 3.8 | 65.0 |
| G | a/o | 25 | 3 | 11 | 1 | 60 |
| | w/o | 13.7 | 5.9 | 20.8 | 1.0 | 58.6 |
| H | a/o | 27 | 0.5 | 9 | 0.5 | 63 |
| | w/o | 15.6 | 1.0 | 18.0 | 0.6 | 64.8 |

In our work consideration was given to other elements which might be substituted in Ti-Nb-Al-V alloys to achieve the same results as molybdenum. We made the alloys Ti-25Al-8Nb-X, where X was variously 1W, 1Ta, 1Hf, and 1V. We did not discern any distinction between the ingredients, all the alloys having poor creep strength. In addition, reference to Table 4 in our U.S. Pat. No. 4,292,077 will show that there is no consistent effect of Hf, Zr, or Sn in Ti-24Al-11Nb alloys. We made the alloys Ti-24Al-11Nb-Z, where Z was variously 0.5Hf, 1Zr, (1Zr-0.5Sn-0.5Si), 0.9C, 1.4Hf and (1.5Hf-0.9C), and found that compared to Ti-24Al-11Nb the alloys had about the same or inferior creep properties, and about the same tensile properties. Other beta stabilizers, such as iron, chromium or nickel are unsuitable for use in the present invention because they form undesirable phases after high temperature exposure. Their addition also reduces the high temperature properties of our type of titanium alloys. Thus, our studies make us conclude that molybdenum is unique in our invention, in combination with the narrow ranges of other elements. Since tungsten is known to be metallurgically equivalent to molybdenum in titanium alloys, it will be substitutional for molybdenum in the present invention. However, the use of tungsten will result in an alloy with higher density and therefore, less desirable density-corrected properties than those which result from the use of molybdenum.

The properties of our molybdenum containing alloys were found to be sensitive to microstructure. Based on the prior work, it was felt that the nature of the Widmanstatten platelet array was the key microstructural feature affecting properties. However, in testing it was found that specimens were produced with coarse non-uniform beta grain size. These test bars had associated with them lower tensile elongation lower fatigue life, and higher creep rupture strength than the other specimens. Analysis showed that in our previous work alloys (Ti-25Al-10Nb-4V) had been redundantly upset and redrawn on a conventional forging press. This working broke up the cast structure and resulted in much finer uniform grain structure than resulted in some of the molybdenum containing alloys. Consequently, we conclude that it is desirable with our new alloys to provide some repetitious working prior to isothermally forging the billet to the final desired shape. The desired microstructure will have an ASTM grain size of about 2–4 (0.15–0.20 mm nominal dimension).

The alloy made as described above is best used with limited time exposure at temperatures in the 565°–675° C. range. We have noticed some instability, in that yield strength increased and ductility decreased after several hundreds of hours exposure. Further heat treatment development may avoid the instability.

Generally, the heat treatment which the alloys of the present invention should be given is similar to that disclosed previously in U.S. Pat. No. 4,292,077. Solutioning or forging should be conducted above the beta transus, followed by aging between 700°–900° C. for 2–24 hours. The cooling rate from the solutioning or forging temperature should be that which produces a fine Widmanstatten structure characterized by acicular alpha two structures of about $50\times5\times10^{-6}$ m dimension mixed with beta phase lathes, generally as shown in FIG. 7(*b*) of the referenced patent. The conditions necessary to achieve this will depend on the size of the article, but generally cooling in air or the equivalent will be suitable for most small articles. Of course, precautions should be taken to protect the forgings from contamination from the environment, similar to steps followed with the conventional alloys of titanium. An alternative heat treatment comprises solutioning above the beta transus followed by quenching in a molten salt bath maintained about 750° C., followed by air cooling.

Although this invention has been shown and described with respect to a preferred embodiment, it will be understood by those skilled in the art that various changes in form and detail thereof may be made without departing from the spirit and scope of the claimed invention.

We claim:

1. A titanium aluminum alloy consisting essentialy of, by atomic percent, 25–27 aluminum, 0.5–4 molybdenum, 7–15.5 niobium, with the balance titanium, wherein the (niobium+molybdenum) content is between 11 and 16 atomic percent.

2. The alloy of claim 1, heat treated at a temperature above the beta transus, and then cooled at a rate sufficient to produce a fine Widmanstatten structure.

3. The alloy of claim 2, further heat treated by aging at 700°–900° C. for 4–24 hours.

4. The alloy of claim 1, wherein molybdenum is 0.5–1.5.

5. The alloy of claim 1, wherein tungsten is substituted for molybdenum in atomic percents up to 4 percent, and wherein the (niobium+molybdenum+tungsten) content is between 11 and 16 atomic percent.

6. The alloy of claim 1, having a tensile elongation at room temperature of at least 1.5%.

7. The alloy of claim 1, having a creep stress to density ratio, based on a 300 hour rupture life at 650° C., of greater than 1.6 kPa per kg per $m^3$.

8. The alloy of claim 1, having a 650° C. dynamic elastic modulus of greater than $9\times10^7$ kPa.

9. A titanium aluminum alloy consisting essentially of, by atomic percent, 25–27 aluminum, 0.5–3.5 molybdenum, 0.5–3.5 vanadium, 7–15 niobium, with the balance titanium, wherein the (vanadium+molybdenum) content is between 1 and 4 atomic percent and the (niobium+vanadium+molybdenum) content is between 11 and 16 atomic percent.

10. The alloy of claim 9, wherein vanadium is 1–3 and molybdenum is 0.5–3.

11. The alloy of claim 9, wherein vanadium is 3 and molybdenum is 1.

* * * * *